United States Patent [19]

Doherty

[11] 4,448,111

[45] May 15, 1984

[54] VARIABLE VENTURI, VARIABLE VOLUME, AIR INDUCTION INPUT FOR AN AIR CONDITIONING SYSTEM

[76] Inventor: Robert Doherty, 3455 Budleigh Dr., Hacienda Heights, Calif. 91745

[21] Appl. No.: 222,721

[22] Filed: Jan. 2, 1981

[51] Int. Cl.[3] ..... F24F 13/06

[52] U.S. Cl. ..... 98/38 E; 98/40 D

[58] Field of Search ..... 98/38 C, 38 D, 38 E, 98/40 R, 40 D, 38 R; 236/49

[56] References Cited

U.S. PATENT DOCUMENTS

| | | | |
|---|---|---|---|
| 3,760,708 | 9/1973 | Burup | 98/40 D X |
| 3,848,799 | 11/1974 | Day | 98/40 D X |
| 4,178,840 | 12/1979 | Caknis | 98/40 D X |

*Primary Examiner*—Albert J. Makay
*Assistant Examiner*—Harold Joyce

[57] ABSTRACT

A unit for heating or cooling multiple rooms including a plenum diffuser mounted parallel within a ceiling runner and supported by hangars within the ceiling plenum. Each unit includes a round inlet collar, an elongated plenum to form a "Venturi," hinged volume dampers, secondary air openings, a bottom plenum chamber, and a pattern controller. The volume dampers housed within the Venturi work in unison. When the volume dampers are open, the unit functions similar to any conventional heating or cooling plenum diffuser. Primary air (heating air or cooling air) will enter the unit and leave through a discharge opening with no change in the air quantity or temperature. As space cooling or heating requirements are met, the volume dampers close at a preset distance, the primary air is reduced (variable volume), the velocity is increased and induces (induction) warm return air through the secondary air openings from the ceiling plenum, or ducted room return, into the primary air stream. This maintains effective room air motion and varies the air discharge temperature (variable discharge temperature) to bring the space to the desired temperature quicker. A pattern controller is located at the discharge opening of the unit, which when rotated, will adjust the air system to numerous air patterns.

8 Claims, 7 Drawing Figures

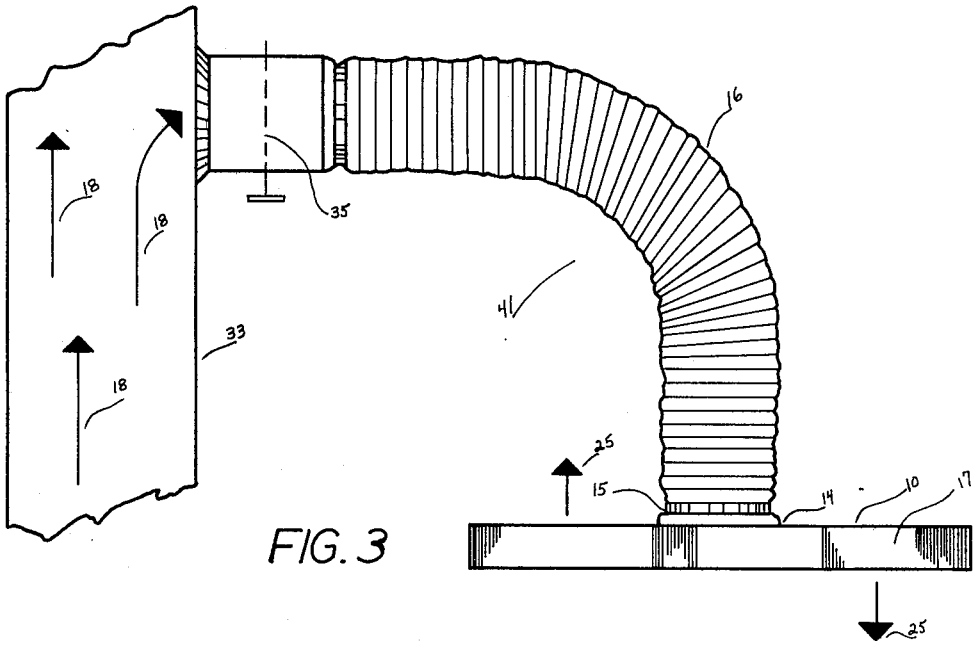
FIG. 3
FIG. 1
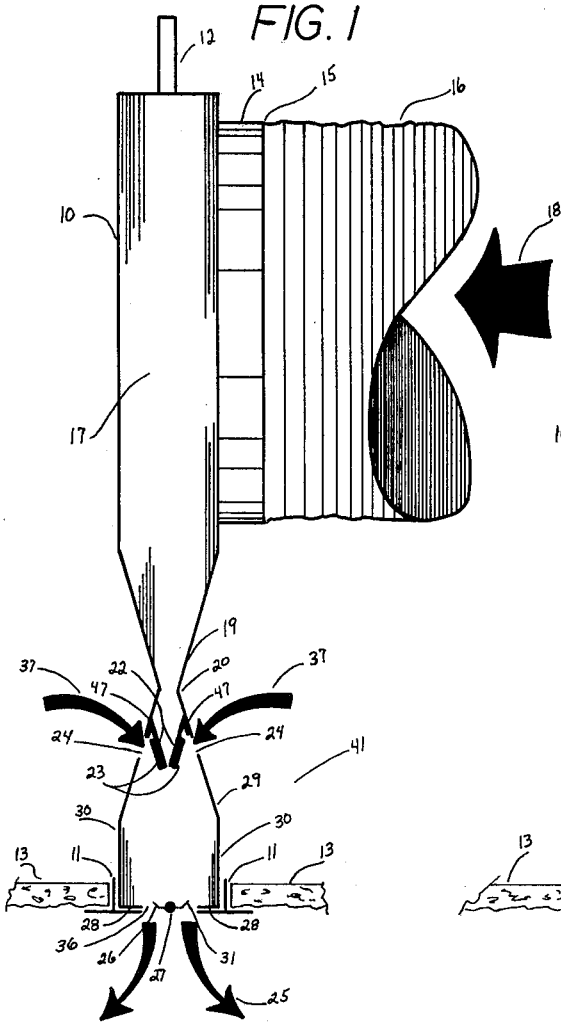
FIG. 2
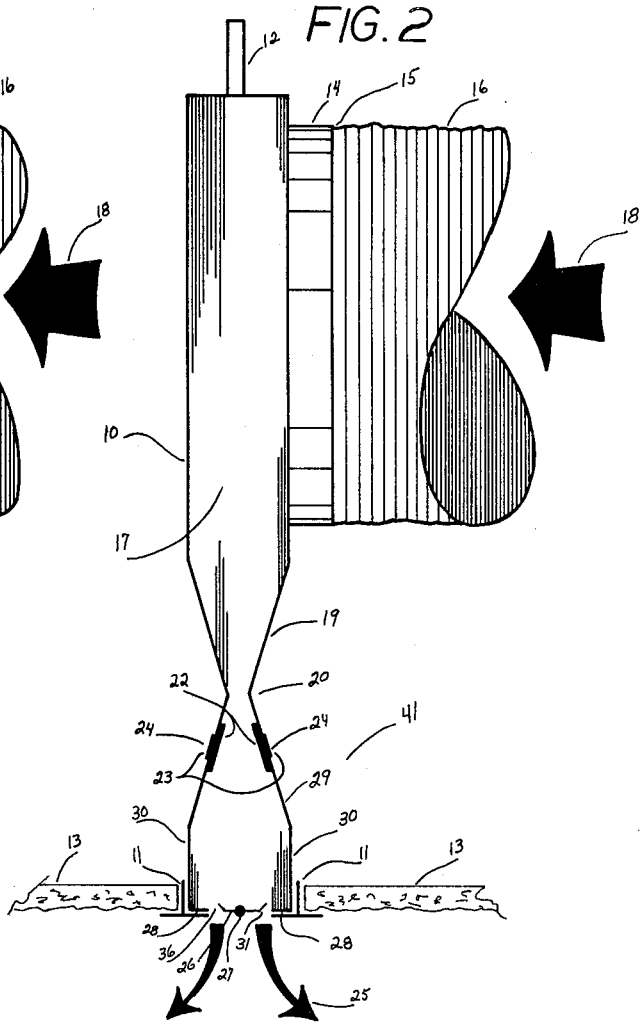

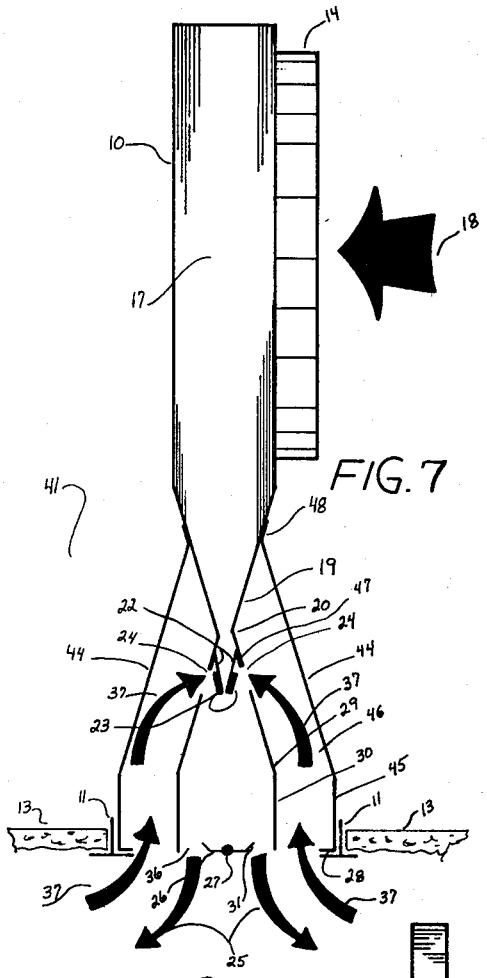
FIG. 7
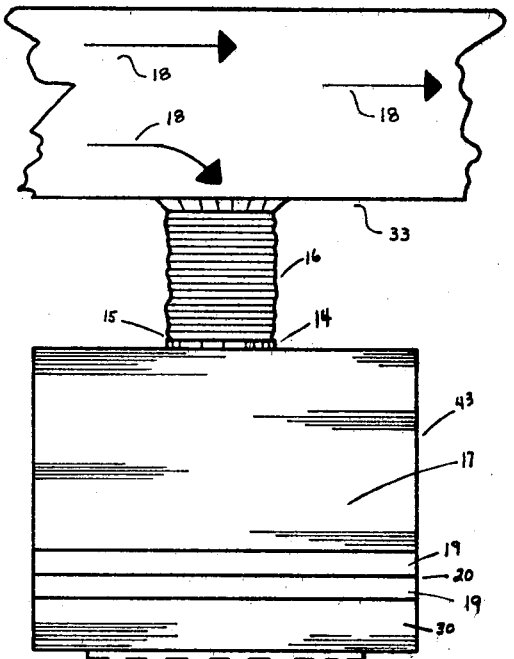
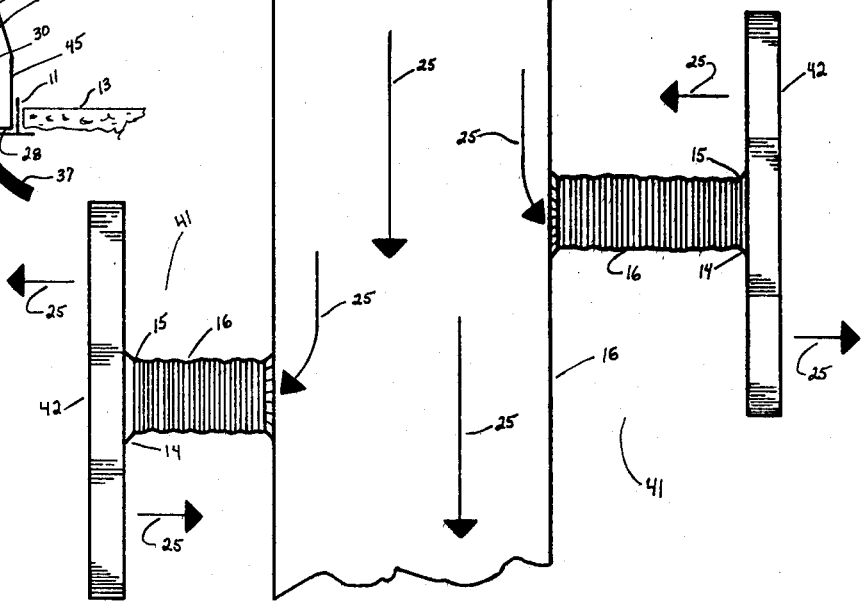
FIG. 5
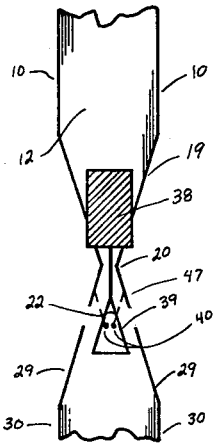
FIG. 6
FIG. 4
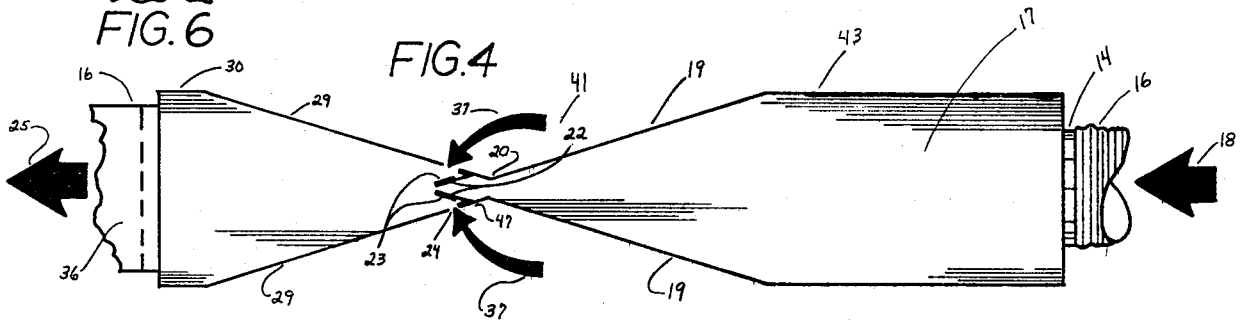

VARIABLE VENTURI, VARIABLE VOLUME, AIR INDUCTION INPUT FOR AN AIR CONDITIONING SYSTEM

BACKGROUND OF THE INVENTION

This invention relates to air conditioning units and more particularly to "Venturi" units in induced air systems for cooling or heating rooms in buildings such as office buildings, schools, libraries, banks, stores, and the like.

In recent years, air conditioning units of the "plenum diffuser" type have come into use as an alternative to both square and round diffusers. A plenum diffuser unit includes an inlet collar and a plenum chamber, integrated with a diffusion and directional device within the chamber for control of air distribution.

The plenum diffuser unit is mounted parallel in a ceiling runner of each room and usually extends about four feet in length. During operation, the unit produces a constant flow of heated or cooled air throughout the room. The advantage of the "plenum diffuser" over square and round diffusers is that it distributes air more evenly and follows the contour of the ceiling which adds to the aesthetics.

However, virtually all prior art plenum diffusers have a serious disadvantage in common. Once the damper is set, the plenum diffuser handles the same volume of air both entering and leaving. No means of continuous capacity control can be utilized while the unit is in operation. Even the more modern plenum diffusers which incorporate a means of varying the volume, (variable volume) has no means of introducing secondary air (return air) back into the unit. This means that when the volume dampers are almost closed and the primary air is reduced, the enclosure could suffer from air stratification due to lack of circulation.

With the induced air "Venturi" plenum diffuser, when the volume dampers are semi-closed, the conditioned air (primary air) is reduced, but through induction, secondary air (return air) is drawn back into the unit. The ultimate effect is that a higher volume of air maintains room air motion and the enclosure is brought to the desired temperature quicker.

SUMMARY OF THE INVENTION

This invention provides an induced air "Venturi" heating or cooling unit, which by incorporating a Venturi and volume dampers, working in unison, will provide the means for inducing and regulating the volume of air.

Briefly, the induced air unit called the "Venturi Unit", includes a round inlet collar which is attached directly to the top center of the plenum chamber and protrudes approximately one or two inches. This collar is used for attaching ductwork and provides an airtight fit for conditioned air entering the plenum diffuser. The elongated rectangular plenum diffuser mounts parallel within the ceiling runner and is supported normally by two ceiling hangars. The plenum diffuser provides the main body of the unit and disperses the entering air evenly within the chamber for proper distribution.

Directly below the plenum chamber, a Venturi is formed, which runs the length of the unit and creates a restriction to greatly increase the velocity of air passing through it. This higher velocity of air is taken advantage of by the two hingedly mounted volume dampers and the slotted air openings which run parallel very closely below the apex of the Venturi. The two hinged dampers are provided with gaskets attached to their longer inward tip to provide an airtight seal when the dampers rest against the slotted secondary air openings. In this open position, the unit functions similar to a conventional heating or cooling plenum diffuser. Primary air will enter the unit and leave through the discharge opening with no change in air quantity or temperature. As space cooling or heating requirements are met, the volume dampers close at a preset distance, the primary air is reduced, the velocity is increased and induces warm air through the secondary air openings. The warm air comes from the ceiling plenum or from the room, by means of a ducted room return and goes directly into the primary air stream. This maintains effective room air motion and varies the discharge temperature to bring the space to the desired temperature quicker. Another advantage is that when the volume dampers are semi-closed, fifty percent of the primary air is reduced, but twenty-five percent is automatically introduced back into the unit as secondary air, to maintain a higher volume of air, and thus eliminate any possibility of stratification.

Below the formation of the Venturi, the plenum chamber is once again formed and houses a pattern controller at its discharge opening. The pattern controller also extends the length of the unit and is made up of a horizontal strip of metal with two 45° turned up edges which directs the discharge air in numerous air patterns.

BRIEF DESCRIPTION OF THE DRAWINGS

These and other aspects of the invention will be more fully understood by referring to the following detailed description and the accompanying drawings in which:

FIG. 1 is an elevational view, partly in section, showing an induced air "Venturi" plenum diffuser mounted within the ceiling plenum with its volume dampers in the semi-closed position.

FIG. 2 is an elevational view partly in section, showing an inducted air "Venturi" plenum diffuser mounted within the ceiling plenum with its volume dampers in the open position FIG. 3 is a plan view showing an induced air "Venturi" plenum diffuser with the main supply duct, the damper, and the flexible branch ductwork connected to it.

FIG. 4 is an elevational view, partly in section, showing an induced air "Venturi" terminal box connected to ductwork, with its dampers in the semi-closed position.

FIG. 5 is a plan view of an induced air "Venturi" terminal box with the main supply duct, the terminal box, and the branch ductwork connected to two or more conventional plenum diffusers.

FIG. 6 is an elevational view showing the induced air "Venturi" damper controller and triangularly shaped linkage, which is used to semi-close the volume dampers.

FIG. 7 is an elevational view, partly in section, showing an induced air "Venturi" plenum diffuser mounted within a ceiling plenum, with its volume dampers in the semi-closed position, and modified with a ducted room return.

DETAILED DESCRIPTION OF THE PREFERRED EMBODIMENTS

Referring to FIG. 1, with the dampers in the semi-closed position, a galvanized steel induced air "Venturi" plenum diffuser 10 is attached at the ceiling 13 parallel within the ceiling runners 11 and is supported by two ceiling hangers 12. The unit normally extends about four feet in length and a little over a foot high. The induced air plenum diffuser is comprised of a round inlet collar 14 which protrudes approximately one or two inches and provides a connecting point 15 for the flexible branch ductwork 16 to insure an airtight fit. The inlet collar is attached permanently to the elongated plenum chamber 17, which when formed, provides the means for straightening the incoming conditioned (primary air) air 18 evenly for proper air distribution. The interior of the plenum chamber can also be lined with insulation (not shown) to either help absorb sound or provide a vapor barrier within the unit. Directly below and continued within the plenum chamber a "Venturi" is formed by bending the metal at a 17 degree angle 19. The angles extend the length of the plenum chamber and terminate at the present opening at the "Venturi" apex 20. This narrow opening is used to create a higher velocity through the unit. Below the point of the "Venturi" apex, the "Venturi" reverses itself by opening the two 17 degree angles in opposite directions 29 to form the bottom section of the plenum chamber 30. This bottom section converts the high velocity air back to low velocity air, for draftless, noiseless operation. Housed within this bottom plenum chamber are two continuous stainless steel hinges which are modified with one side being approximately ¼" wide 47 and the other side being approximately ¾" wide 22. The ¼" side 47 is permanently affixed directly below the vortex 20 of the "Venturi" 19. The longer ¾" wide 22 hinges rotate at the hinge axle, and when in the semi-closed position of FIG. 1, act as volume dampers to regulate the amount of air passing through them. On the lower section of the ¾ wide hinge, and in the direction of the secondary air openings, a continuous strip of polyurethane gasket 23 is permanently installed. When this is rested against the secondary air openings 24 it completely seals them.

This position is achieved by the hinges being spring loaded and automatically forces the longer hinge 22 to rest against the secondary air openings 24, referred to hereinafter as the open position of the dampers. This is shown in FIG. 2, and will be described further within the disclosure. Below the vortex 20 of the "Venturi" 19 and directly across from gasketed hinged dampers 23, are the secondary air openings 24. These slotted openings are spaced uniformly to extend the length of the unit. The openings are preferably 5" long, ⅜" wide, and are spaced every 1" along the length of both sides of the plenum 29.

In the bottom section of the plenum, where the discharge air 25 is emitted 36, a pattern air controller 26 is installed. The pattern controller is a horizontal narrow strip of metal 26 with turned up edges at a 45° angle 31. It extends the length of the unit and when rotated manually on its center axle 27 in a slight vertical position, will change the air pattern. On the extreme tip of both sides of the bottom plenum 30, is a metal flange 28 which extends the length of the unit, provides rigidity to the chamber and insures a flat surface to rest against the ceiling runners 11.

FIG. 2 shows an induced air, "Venturi", plenum diffuser which is identical to the unit shown in FIG. 1, except its dampers are in the open position, and thus is operating similar to a conventional plenum diffuser.

FIG. 3 shows an induced air "Venturi" plenum diffuser 10 in plan view within the ceiling plenum 41 attached to ductwork. The conditioned air 18, hereafter referred to as primary air, is either heated by a boiler or cooled by a chiller from a remote central plant (not shown) it is delivered by means of an air handler (not shown) which inclues a blower (not shown) and forces the air through the main supply duct 33. The air is then dispersed through branch ductwork 16, and the quantity of air is usually adjusted by means of a volume damper 35, prior to entering the induced air "Venturi" plenum diffuser 10. Referring to FIG. 2, as the primary air 18 enters the unit through the branch ductwork 16, it is dispersed evenly within the plenum chamber 17 and forced through the bent-angled 17° plenum 19, through the vortex or the "Venturi" 20, through the reversed angle openings 29 through the bottom section of the plenum chamber 30 and out through the discharge openings 36, where it is properly dispersed into the room. As shown in FIG. 2, the hinged volume dampers 22 are in the open position resting against the secondary air openings 24, thus closing off entry to any secondary air 37. With the unit operating in this position, it functions similar to any conventional heating or cooling plenum diffuser 42. Primary air will enter and leave through the unit as described above with no change in air quantity or temperature.

If the unit is used within the interior of a building and cooling is required, a thermostat would be set at a predetermined temperature. If overcooling occurs in the FIG. 1 form, the thermostat (not shown) automatically energizes the damper controller (either electric or pneumatic), as indicated in FIG. 6, at 38, and forces the triangleshaped linkage 39 in a downward position, thus semi-closing the units volume dampers 22. The immediate effect is that cool primary air travels once again through the unit, only now, as it passes through the semi-closed dampers 22, the volume of air is reduced (variable volume) and the velocity of the primary air is further increased. This induces (induction) warm secondary air 37 from the ceiling plenum 41 through the secondary air openings 24. As the warm secondary air 37 mixes with the cold primary air stream 18, the discharge temperature *increases* (variable discharge temperature) and offsets the cooling effect to bring the space to the desired room temperature. When the thermostat is satisfied, it de-energizes the damper controller 38, allowing the triangular shaped linkage 39 to move upward to its original position, thus releasing the hinged dampers at their contact points 40. This allows the spring loaded hinges 47, located within the short side of the volume dampers 47, to return the gasketed long side of the hinges 23 to rest against and seal the secondary air openings 24. In this position as shown in FIG. 2, the unit once again will function similar to a conventional plenum diffuser, with full air volume to achieve maximum cooling.

If the unit is used at the perimeter of a building and maximum heating is required, as shown in FIG. 2, the thermostat would be once again set at a predetermined temperature. If overheating occurs in FIG. 1, the thermostat automatically energizes the damper controller 38 and the same basic mechanical function occurs again, as fully described above to semi-close the dampers. The only difference is in the thermal aspects. In this case, instead of cold air traveling through the unit, hot air would travel through it. The function of the secondary air entering the unit 37 reverses its purpose.

As described above, when the unit is used for cooling, the warmer secondary air 37 entering through the secondary air openings 24, mixes with the primary air stream and *increases* the discharge air 25 temperature. In the heating mode, the warmer secondary air 37 entering through the secondary air openings 24 mixes with the primary air 18 stream and decreases the discharge air 25 temperature. This would offset the overheating effect to bring the space to the desired room temperature and satisfy the thermostat. When the thermostat is satisfied, the dampers open by the same mechanical function fully described above, and the unit 10 will function as shown in FIG. 2 similar to a conventional plenum diffuser with full air volume to achieve maximum heating.

FIG. 4 shows an induced air "Venturi" terminal box 43 with its volume dampers 22 in the semi-closed position. As readily seen, the terminal box 43 is a modified and bigger version of the plenum diffuser 10. Its uniqueness lies in its ability to handle larger quantities of air for larger spaces within a building, in which two or more conventional plenum diffusers 42 must be used. Unlike the induced air plenum diffuser 10, the unit 43 is mounted in a horizontal position, the pattern controller 26 is omitted, and ductwork is attached to the entrance 18 and leaving side of its plenum. Aside from this, its function, both mechanically and thermally is identical to the induced air plenum diffuser as fully described in FIG. 3.

FIG. 5 shows an induced air terminal box 43 within the ceiling plenum 41 attached to ductwork 33, 16. The configuration is similar to the disclosure in FIG. 3, only multiple conventional plenum diffusers 42 are attached to an induced air "Venturi" terminal box 43. As a review, primary air 18, from the main ductwork 33 travels through the branch ductwork 16, and into the terminal box 43. The air is either reduced in quantity and premixed with warm ceiling air, as in FIG. 1, or is allowed to go through the unit unchanged depending on the position of the volume dampers 22. In either event, the air is discharged 25 through the branch ductwork 16, and is dispersed through the multiple conventional plenum diffusers 42.

FIG. 6 is a close-up view of the induced air units damper controller 38 attached to the units. As seen, the damper controller has forced the triangularly-shaped linkage 39 to its furthest downward position which semi-closes the volume dampers, as shown in FIG. 1. This position is called for by the thermostat energizing the damper controller 38 because of an overheating or overcooling condition within the room, as fully described in FIG. 3. In actual operation, the damper controller linkage moves downward and squeezes the points of the rods 40 which are part of the longer and gasketed hinges 23 and protrude through the plenum chamber casing 40. A slotted opening is provided (not shown) in the plenum casing to allow these rods to move back and forth. This position is held FIG. 6 until the overheating or overcooling condition is corrected and satisfies the thermostat.

When the thermostat is satisfied, the damper controller 38 is once again energized and moves upward to allow the triangular-shaped control linkage 39 to return to its original position (not shown.) When the triangularshaped control linkage 39 is in the original position, the spring loaded hinge, which is housed within its short side 47 forces the longer gasketed hinge 23 to rest against and seal the secondary air openings 24. In this position, as shown in FIG. 2, full heating or cooling is achieved.

FIG. 7 shows an induced air "Venturi" plenum diffuser 10 with the dampers in the semi-closed position of FIG. 1, and modified with a ducted room return. As described in the preceeding units mentioned, both in plenum diffusers 10 and terminal boxes 43, had warm air returned into the secondary air openings 24 from the ceiling plenum 41. With this modification, warm air trapped at the ceiling 13 can be fed directly into the secondary air openings 24 from the room.

Its uniqueness is that the air returning directly from the room has been filtered and openings at the ceiling (not shown) which allow secondary air 39 to enter the ceiling plenum 41, can be eliminated. The ducted room return extends the length of the plenum and is formed by two 17° metal angles 44. The top portion has a short flange 48 which is permanently affixed to the upper angled plenum chamber 19. The lower section of the ducted room return 45 is formed by a vertical extension of the 17° metal angles 44, and follows the contour of the bottom plenum chamber 30. At the very end of the lower section of the ducted room return is a $\frac{3}{8}''$ flange 28 facing inward, which rests on the ceiling runner 11. When formed in its entirety, the ducted room return plenum FIG. 7 extends about an inch out from the exterior of the upper and lower "Venturi" 19, 20, 29, 30 plenum chamber casing and provides a return chamber 46 for the secondary air 37. This unit is one of many modifications which is derived from the basic invention.

The "Venturi" with volume dampers as disclosed can be used in conjunction with a standard diffuser or sidewall grille as well as a linear plenum diffuser. Another obvious modification of both the plenum diffuser and terminal box is to omit the volume dampers. This will still provide the necessary induction to return secondary air to the unit, but instead of being a variable volume unit, would become a constant volume unit.

The foregoing description is couched primarily in the language of the air conditioning trade (including both heating and cooling systems) but in certain cases, it has been found that said trade language does not lend itself ideally to the construction of claims ranging from broad or generic to somewhat less broad and, consequently, certain claim language other than the foregoing trade language will be used in the claims and in order to fully identify all such claim language, its correlation with the previously-used claim language and/or the various elements of the invention shown in the drawings will be pointed out in the immediately following nomenclature section of this specification.

In the claim language, the expression "air conditioning system" refers to the entire apparatus illustrated in, and previously described in all its various forms whether for the purpose of space cooling or heating.

In the claim language, the input duct referred to is equivalent to the structures shown at 16 and 33 in the drawings and the so-called "upstream end thereof" is equivalent to the right end of the duct 16 shown in FIG. 1, or its upstream equivalent in any of the other Figs., while the so-called "downstream end" is equivalent to the left end shown at 15 in FIG. 1 of the duct 16 where it is connected by the collar 14 to the plenum chamber 10.

Incidentally, it should be noted that the so-called "plenum chamber" includes both such plenum chambers as those shown at 10 in the Figs., and also includes the so-called terminal boxes shown at 43, particularly as illustrated in FIGS. 4 and 5, which are also plenum chambers within the meaning of the claim language.

The so-called "output duct connected to the plenum chamber at one end and at another end to the interior of a room" is the structure shown in the drawings at 30 and referred to in the foregoing description in trade language as the bottom section 30 of the plenum chamber 10, while the opposite end of the structure 30 where it is connected to the interior of a room comprises the end of the structure 30 where it abuts the metal flange 28 in the ceiling hole defined by the runner 11 in the ceiling 13 so that the air can be emitted as the discharge air 25 through the emission hole 36 into the area below the ceiling 13 shown in Figs. 1 and 2, which is the so-called "interior of a room" referred to in the claim language.

In the claim language, the so-called "Venturi means" is the Venturi indicated at 19 in the drawings and the so-called "controllably adjustable variable" aspect of said "Venturi means" is provided by the structures shown at 23 in the drawings and referred to in the trade language of the foregoing description as gasketed hinged dampers 23. These are considered as part of the so-called "controllably adjustable variable Venturi means" of the claim language. The so-called "lateral air induction opening means" of the claim language comprises the openings shown at 24 in the drawings and referred to in the foregoing trade language description as secondary air openings 24 which are of longitudinally extending slotted construction. In the claim language, the so-called "control means" or "control member" for varying the variable Venturi means is the same as the structure shown diagrammatically at 38 in FIG. 6 and referred to in the foregoing trade language description as the induced air unit's damper controller 38 taken in conjunction with the triangular-shaped linkage 39 also shown in FIG. 6. The so-called "air-condition sensing means" and/or the so-called "temperature sensing means" and also the so-called "effective servo means operated thereby" of the claim language is also essentially that structure just mentioned above and shown diagrammatically at 38 in FIG. 6.

It is believed that the foregoing claim language identification provides completely adequate identification and correlation of all claim language used with the structures shown in the drawings and the trade language used in identifying same in the foregoing descriptive portion of the specification.

It should be understood that the figures and the specific description thereof set forth in this application are for the purpose of illustrating the present invention and are not to be construed as limiting the present invention to the precise and detailed specific structures shown in the figures and specifically described hereinafter. Rather, the real invention is intended to include substantially equivalent constructions embodying the basic teachings and inventive concept of the present invention.

What is claimed is:

1. A variable Venturi, variable volume, air induction, input for an air conditioning system for controlling the amount of ambient air inducted into an air conditioning system comprising: in an air conditioning system having an input duct provided with an upstream end adapted to be connected to an air-temperaturemodifying and air-moving apparatus at said upstream end thereof and having a downstream end provided with, and connected to, an air-diffusing plenum chamber, the provision of an output duct connected to the plenum chamber at one end and at another end to the interior of a room which is to be air conditioned, said output duct being positioned between said plenum chamber and the interior of a room which is to be air conditioned and being provided with controllably adjustable variable Venturi means in circuit therewith and being provided with and operatively connected to a control member for varying said variable Venturi means between a substantially fully open relationship with respect to the interior of said output duct and an inner, constricted, maximum-closed relationship with respect to the interior of said output duct whereby to reduce the volume of air flow therethrough from the plenum chamber into the interior of the room while increasing the linear velocity thereof; and lateral air induction opening means extending laterally through said output duct from the exterior thereof to the interior thereof adjacent to said variable Venturi means and in direct exterior-to-interior communication with the variable volume, variable linear velocity, interior air passing through the interior of said output duct and said variable Venturi means between the plenum chamber and the room to be air conditioned whereby to cause correspondingly variable induction of ambient air from a position exterior of said air induction opening means in said output duct into the interior thereof for feeding movement thereof and effective mixing thereof with the air passing through said output duct from the plenum chamber to the interior of the room to be air conditioned; said variable Venturi means comprising first inner walls surfaces of said output duct smoothly and continuously converging in a downstream direction into a reduced cross-sectional area and then further comprising second inner wall surfaces of said output duct smoothly and continuously diverging in a downstream direction from said first wall surfaces and additionally comprising multiple controllably opposedly and correlatedly pivotally movable swinging volume dampers hingedly mounted to the inner wall surfaces slightly downstream from said reduced cross-sectional area at transversely spaced locations, said dampers having inwardly and outwardly swingably movable air-flow-modifying downstream ends located closely adjacent to said reduced cross-sectional area; said lateral air induction opening means being positioned in said second wall surfaces of the output duct downstream from said reduced cross-sectional area and slightly upstream from said free air-flow-modifying downstream ends of said swinging dampers.

2. Apparatus as defined in claim 1, wherein said air induction opening means are exteriorly in direct communication with ambient air outside of the interior of the room to be air conditioned in a selected region filled with a selected body of supplementary ambient air having desired characteristics for mixing with the interior flowing primary air passing from the plenum chamber into the interior of the room to be air conditioned.

3. Apparatus as defined in claim 2, wherein said control member operably connected to said variable Venturi is positioned for convenient manual operation as desired.

4. Apparatus as defined in claim 2, wherein said control member operably connected to said variable Venturi is provided with air-condition-sensing means and effective servo means operated thereby and effectively coupled to said variable Venturi in a power-applying manner for operating same in a manner corresponding to, and which is a function of, the condition of the flowing air sensed by said sensing means whereby to bring about a corrective action relative to mixed input air flowing into the interior of the room being air conditioned by way of said output duct.

5. Apparatus as defined in claim 1, wherein said air induction opening means are exteriorly provided outside of the exterior of said output duct with enclosing shroud means extending therefrom into communication with selected portions of the interior of the room to be air conditioned whereby to cause the variable volume inducted air drawn by suction through the partially closed variable Venturi into the interior of the output duct to originate from selected portions of the room to be air conditioned and thus, causing said induced ambient air to be effectively recirculated air, whereby to increase the thermodynamic efficiency of operation of the apparatus and to correspondingly reduce the amount of energy required for operating the primary air conditioning system.

6. Apparatus as defined in claim 5, wherein said control member operably connected to said variable Venturi is positioned for convenient manual operation as desired.

7. Apparatus as defined in claim 5, wherein said control member operably connected to said variable Venturi is provided with air-condition-sensing means and effective servo means operated thereby and effectively coupled to said variable Venturi in a power-applying manner for operating same in a manner corresponding to, and which is a function of, the condition of the flowing air sensed by said sensing means whereby to bring about a corrective action relative to mixed input air flowing into the interior of the room being air conditioned by way of said output duct.

8. Apparatus as defined in claim 5, wherein said control member operably connected to said variable Venturi is provided with temperature-sensing means and effective servo means operated thereby and effectively coupled to said variable Venturi in a power-applying manner for operating same in a manner corresponding to, and which is a function of, the temperature sensed by said sensing means whereby to bring about a corrective action relative to mixed input air flowing into the interior of the room being air conditioned by way of said output duct.

* * * * *